US009597892B2

(12) United States Patent
Chang

(10) Patent No.: US 9,597,892 B2
(45) Date of Patent: Mar. 21, 2017

(54) INKJET PRINTING METHOD AND INKJET PRINTING APPARATUS

(71) Applicant: Yuan Chang, Newtown Square, PA (US)

(72) Inventor: Yuan Chang, Newtown Square, PA (US)

( * ) Notice: Subject to any disclaimer, the term of this patent is extended or adjusted under 35 U.S.C. 154(b) by 0 days.

(21) Appl. No.: 15/021,271

(22) PCT Filed: Sep. 27, 2013

(86) PCT No.: PCT/CN2013/084393

§ 371 (c)(1),
(2) Date: Mar. 11, 2016

(87) PCT Pub. No.: WO2015/042846

PCT Pub. Date: Apr. 2, 2015

(65) Prior Publication Data

US 2016/0297207 A1 Oct. 13, 2016

(51) Int. Cl.
*B41J 2/21* (2006.01)
*B41J 2/045* (2006.01)

(52) U.S. Cl.
CPC ..... *B41J 2/2117* (2013.01); *B41J 2/04505* (2013.01); *B41J 2/04586* (2013.01)

(58) Field of Classification Search
CPC ... B41J 2/2117; B41J 2/04586; B41J 2/04505
See application file for complete search history.

(56) References Cited

U.S. PATENT DOCUMENTS 6,916,130 B1 * 7/2005 Holt ..... B41J 3/407 116/206
7,178,898 B2 2/2007 Hoshino
7,562,957 B2 7/2009 Mills et al.
2003/0090539 A1 5/2003 Lahut et al.
2005/0237352 A1 10/2005 Yoneyama
2006/0158473 A1 7/2006 Mills et al.
(Continued)

*Primary Examiner* — Justin Seo

(57) ABSTRACT

The present invention provides an inkjet printing method using an inkjet printing apparatus, the method including: Control the print heads in the first row of the first group on carriage to print the first color printing image on the transparent media. Control the first nozzle section on print heads in the second row of the second group on carriage to print the first white ink layer on the first color printing image. Control the second nozzle section on black ink print head in the second row of the first group on carriage to jet black ink to form coating layer on the first white ink layer. Control the third nozzle section on print heads in the second row of the second group on carriage to print the second white ink layer on the said coating layer. Control the print heads in the third row of the first group on carriage print the second color printing image on the second white ink layer. The print heads are arranged in three rows in this invention. The print heads in the second row are divided into three nozzle sections. With a single direction transport of the transparent media rather than back and forth transport, double sides images can be formed through five layers printing on the transparent media by controlling three nozzle sections on black and white ink print head in the second row.

15 Claims, 11 Drawing Sheets

(56) References Cited

U.S. PATENT DOCUMENTS

| | | | | |
|---|---|---|---|---|
| 2006/0260489 | A1* | 11/2006 | Fernandez Conesa | B41J 11/002 101/424.1 |
| 2008/0211866 | A1* | 9/2008 | Hill | B41M 3/008 347/42 |
| 2010/0207987 | A1* | 8/2010 | Sano | B41J 2/2114 347/15 |
| 2011/0069128 | A1 | 3/2011 | Onishi | |
| 2012/0056922 | A1* | 3/2012 | Yoshida | B41J 2/2117 347/9 |
| 2012/0081461 | A1* | 4/2012 | Kakutani | B41J 2/2117 347/43 |
| 2012/0120168 | A1 | 5/2012 | Kachi | |
| 2014/0043386 | A1* | 2/2014 | Saita | B41J 11/002 347/15 |
| 2014/0370214 | A1* | 12/2014 | Araki | B41M 5/0029 428/35.7 |

* cited by examiner

INKJET PRINTING METHOD AND INKJET PRINTING APPARATUS

FIELD OF THE INVENTION

This invention brings a new type of inkjet printing method. A new multi-layers inkjet printing method and the inkjet printing apparatus to realize multi-layers print is detailed introduced.

BACKGROUND OF THE INVENTION

The printing image is formed when the print heads jet ink to the media. Observers can see the specific color when one or multiple kinds of ink drop on the media such as yellow, cyan, magenta, black, etc. This requires the image to be printed on the white media or similar white media to make sure the color finally printed is correctly seen by the observers. Or else, the image seen by the observers will be influenced by the background color shielded by printing image.

Therefore, before printing color image on the non-white media (such as color media or transparent media), white ink should be printed on the media as background. For example, to print a color image on the black or color media, we need to print white ink in the field where color image will be printed first, and then print color image shielding the white ink layer. The base color white protects the color image from being influenced by the base color of the black media or color media.

To print on the transparent media, you need to print color ink on the transparent media first and then print white ink shielding color ink. Then you can observe the color printing image through transparent media in the front of the said media, which is called the foreground color printing mode. The white ink layer can be served as the background of color image so that the color observed from the front of transparent media is normally displayed.

To print double images on the transparent media, you need to print the first color image on the transparent media and then print the first white ink layer shielding the first color image. If the second color image is the same with the first color image, you can directly print the second color image on the first white ink layer. Since the white ink can transmit light, the first color image layer may be mixed with the second color image layer. Therefore, if the second color image is different from the first color image, we need to print a gray ink layer on the first white ink layer. The second color image will be abnormally displayed if it is printed directly on the gray ink layer, so the second white ink layer should be printed on gray ink layer before printing the second color image. This not only ensures the saturation and verisimilitude, but also avoids the mixture of the first color image layer and second color image layer. In conclusion, five layers of ink should be printed if we want to print double layers color image on transparent media. The inkjet printing apparatus and printing method need to be provided for five layers printing through media one-transport.

SUMMARY OF THE INVENTION

In view of the problems in the prior art, the purpose of the present invention is to provide with a method of printing five layers on printing medium using an inkjet printing apparatus.

To realize the purpose above, the present invention presents a method of inkjet printing, wherein comprises:

a) Controlling the print heads in the first row of the first group on carriage to print the first color printing image on the transparent media; the said print heads in the first row include the color ink heads used to print the first color printing image;

b) Controlling the first nozzle section on print heads in the second row of the second group to print the first white ink layer on the first color printing image; the said print heads in the second row of the second group include one or multiple heads which jet white ink.

c) Controlling the second nozzle section on black ink print head in the second row of the first group to jet black ink to form coating layer on the first white ink layer; the print heads in the second row include one or multiple heads which jet black ink;

d) Controlling the third nozzle section on print heads in the second row of the second group to print the second white ink layer on the said coating layer; the said print heads in the second row of the second group include one or multiple heads which jet white ink;

e) Controlling the print heads in the third row of the first group to print the second color printing image on the second white ink layer; the said print heads in the third row include the color ink heads used to print the second color printing image.

The method of inkjet printing, wherein the said step c) is to control the second nozzle section on black ink print head in the second row of the first group and the second nozzle section on print heads in the second row of the second group to form coating layer together on the first white ink layer; the print heads in the second row include one or multiple heads which jet black ink and one or multiple heads which jet white ink.

The method of inkjet printing, wherein the said print heads in the first group and those in the second group are aligned horizontally, and they share the same axis. To be specific, the print heads in the first row of the first group and those in the first row of the second group share the axis a-a. The print heads in the second row of the first group and those in the second row of the second group share the axis b-b. The print heads in the third row of the first group and those in the third row of the second group share the axis c-c.

The method of inkjet printing, wherein the said print heads in both the first group and the second group are the same print heads.

The method of inkjet printing, wherein the first color printing image is different from the second color printing image.

The method of inkjet printing, wherein the first nozzle section is composed of nozzles which lie on the top ⅓ of the print head in the second row; the second nozzle section is composed of nozzles which lie in the middle ⅓ of the print head in the second row; the third nozzle section is composed of nozzles which lie in the bottom ⅓ of the print head in the second row.

The method of inkjet printing, wherein the said print heads in the first row of the first group jet color inks of Cyan, Magenta, Yellow and Black, and the number of the said print heads in the first row of the first group is integer multiple of four. The total number for each color print heads is the same with another color print heads.

The method of inkjet printing, wherein the said print heads in the first row of the first group jet color inks of Cyan, Magenta, Yellow, Black, Light Cyan and Light Magenta, and the number of the said print heads in the third row of the first group is integer multiple of six.

The method of inkjet printing, wherein the said print heads in the third row of the first group jet color inks of Cyan, Magenta, Yellow and Black, and the number of the said print heads in the third row of the first group is integer multiple of four.

The method of inkjet printing, wherein the said print heads in the third row of the first group jet color inks of Cyan, Magenta, Yellow, Black, Light Cyan and Light Magenta, and the number of the said print heads in the third row of the first group is integer multiple of six.

The method of inkjet printing, wherein the transparent media is glass or plastics.

The method of inkjet printing, wherein the said coating layer in step c) is black coating layer.

The method of inkjet printing, wherein the said coating layer in step c) is gray coating layer which is mixed by black ink and white ink.

The present invention provides with an inkjet printing apparatus comprising: print heads used to jet ink and a control system used to control print heads to work; the said print heads are arranged in two groups; the print heads in the first group are used to jet color ink and the print heads in the second group are used to jet coating ink; the said print heads in the first group and second group are both composed by print heads in the first row, the second row and the third row along the transportation direction of the transparent medium; the amount of print heads in the first, second and third rows are the same. The said print heads in the first group and those in the second group are aligned horizontally, and they share the same axis; wherein the said print heads in the first and third rows of the first group both jet ink, and the middle nozzle section on the black ink print head in the second row of the first group jet black ink; the said print heads in the first and third rows of the second group don't jet ink, and print heads in the second row of the second group jet ink.

The inkjet printing apparatus, wherein the said print heads in the second row of the first group and the second row of the second group are all divided into three nozzle sections: the first nozzle section is composed by the top of nozzles, the second nozzle section is composed by the middle of nozzles and the third nozzle section is composed by the bottom of nozzles, the first and third nozzle sections in the second row of the first group don't jet ink, while the second nozzle section in the second row of the first group jets ink; the first, second and third nozzle sections in the second row of the second group jet ink together.

The inkjet printing apparatus, wherein the said print heads in the second row of the first group and the second row of the second group are all divided into three nozzle sections: the first nozzle section is composed by the top of nozzles, the second nozzle section is composed by the middle of nozzles, the third nozzle section is composed by the bottom of nozzles, the first and third nozzle sections in the second row of the first group don't jet ink, while the second nozzle section in the second row of the first group jets ink; the first and third nozzle sections in the second row of the second group jet ink, while the second nozzle section in the second row of the second group doesn't jet ink.

The inkjet printing apparatus, wherein the first nozzle section is composed of nozzles which lie on the top ⅓ of the print head; the second nozzle section is composed of nozzles which lie in the middle ⅓ of the print head; the third nozzle section is composed of nozzles which lie in the bottom ⅓ of the print head. The inkjet printing apparatus, wherein the first nozzle section is composed of nozzles which lie on the top ⅜ of the print head; the second nozzle section is composed of nozzles which lie in the middle ¼ of the print head; the third nozzle section is composed of nozzles which lie in the bottom ⅜ of the print head.

The inkjet printing apparatus, wherein the print heads in the first row of the first group and those in the first row of the second group share the axis a-a; The print heads in the second row of the first group and those in the second row of the second group share the axis b-b; The print heads in the third row of the first group and those in the third row of the second group share the axis c-c.

The inkjet printing apparatus, wherein the print heads in the first row and those in the second row are interlaced end to end along the direction of nozzle arrangement for both the first group and second group; the print heads in the second row and those in the third row are interlaced end to end along the direction of nozzle arrangement for both the first group and second group.

The inkjet printing apparatus, wherein the ink jet by the said print heads of the first group includes four colors: Cyan, Magenta, Yellow and Black; The ink jet by the said print heads of the first group can also includes six colors: Cyan, Magenta, Yellow, Black, Light Cyan and Light Magenta. The print head which jets the same color of ink is more than one. Each row of print head in the second group includes at least one white ink print head. Each row of print head in the second group includes at least one transparent ink print head.

Compared to the existing technology, the advantage of this invention is as follows:

1. In this invention, the print heads in the inkjet printing apparatus are arranged in three rows. With a single direction transport of the transparent media rather than back and forth transport, print heads print five layers of inks to form two layers of different color images on transparent media.
2. In this invention, the inkjet printing apparatus can realize five types of printing mode: the foreground color printing, background color printing, full color printing, double sides image printing and five layers printing by controlling the print heads in the first, second and third rows of the first group and the second group.

DETAILED DESCRIPTION OF THE EMBODIMENT

Preferred embodiments of printing method and printing apparatus according to the present invention is described but not confined below with reference to the accompanying figures.

The following part introduced the inkjet printing apparatus and printing method based on the figures.

Figure 1:
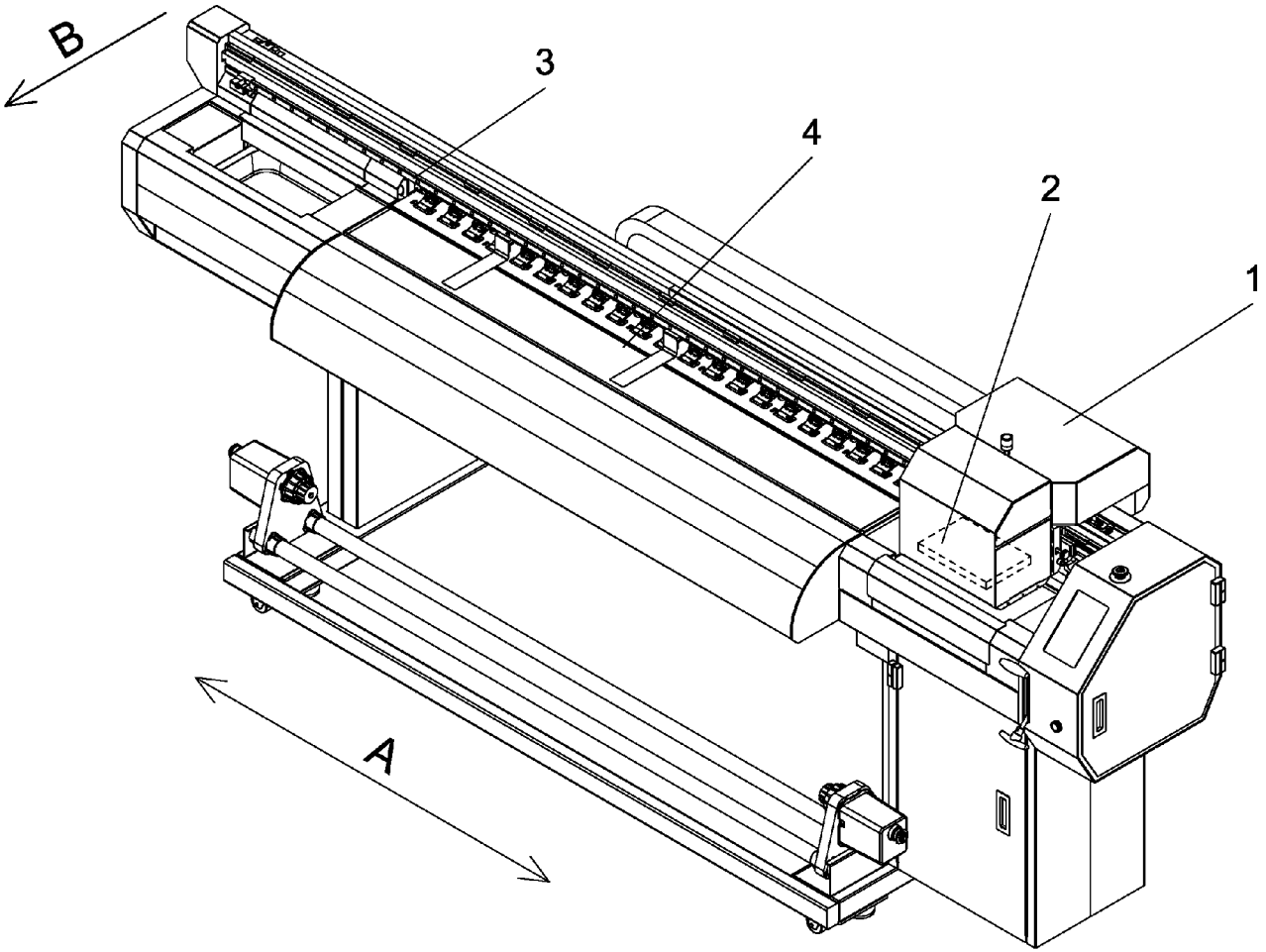
FIG. 1 is a space diagram of inkjet printing apparatus in the present invention.

As shown in FIG. 1, the inkjet printing apparatus in the present invention includes a printing carriage 1, a head plate 2 which is installed on the carriage installing multiple print heads which jet inks to the media.

The ink in the present invention can be either solvent ink or UV ink. The inkjet printing apparatus in the present invention also includes a supporting beam 3, a printing platen 4 and a control system. The printing carriage 1 is installed on the supporting beam 3. The printing media are placed on the printing platen 4. The control system controls the printing carriage 1 to move horizontally forward (left) and backward (right) along the supporting beam 3 (according with A-axis/Arrow A direction) and controls the media steps motion along the direction perpendicular with supporting beam 3 (according with B-axis/Arrow B direction).

Figure 2:
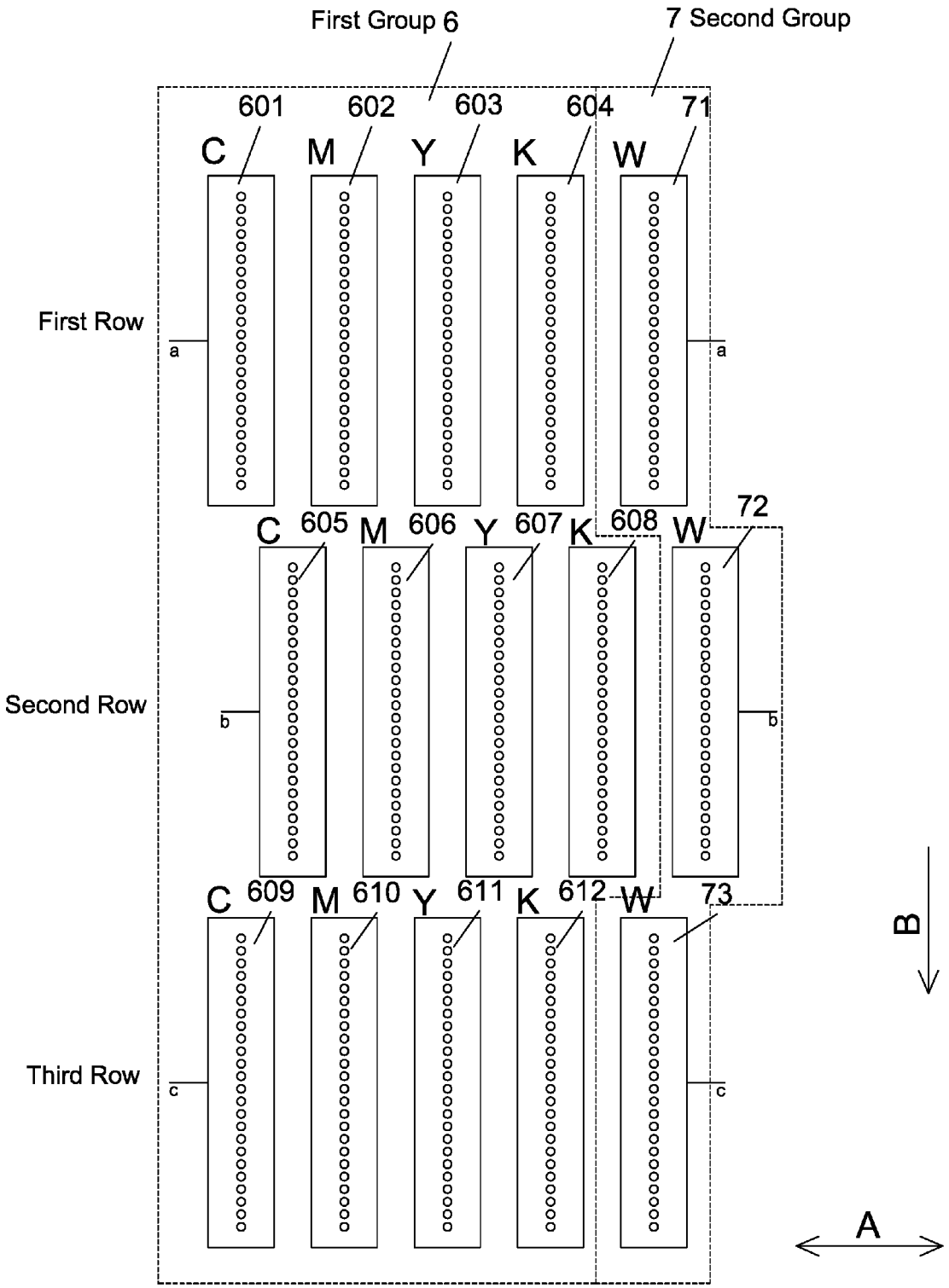
FIG. 2 is a sketch map of the print heads arrangement on carriage in one embodiment in the present invention.

FIG. 2 is the illustration of print head arrangement on carriage in one embodiment. The print heads on carriage include the first group of print heads 6 and the second group of print heads 7. The first group of print heads 6 jet color ink to form color image. The first group of print heads 6 includes 12 heads 601-612, which are used to print cyan ink, magenta ink, yellow ink and black ink. Print heads in the first group 6 include three rows and each row includes four print heads. Print heads in the first row include heads 601-604. Print heads in the second row include heads 605-608. Print heads in the third row include heads 609-612. Wherein print head 601, 605 and 609 jet cyan ink; print head 602, 606 and 610 jet magenta ink; print head 603, 607 and 611 jet yellow ink; print head 604, 608 and 612 jet black ink. The print heads in the first group 6 which jet the same color of ink are interlaced end-to-end arranged along the direction of nozzle arrangement. That is to say, Head 601 and 605 are interlaced end-to-end arranged along the direction of nozzle arrangement; Head 605 and 609 are interlaced end-to-end arranged along the direction of nozzle arrangement; Head 602 and 606 are interlaced end-to-end arranged along the direction of nozzle arrangement; Head 606 and 610 are interlaced end-to-end arranged along the direction of nozzle arrangement; Head 603 and 607 are interlaced end-to-end arranged along the direction of nozzle arrangement; Head 607 and 611 are interlaced end-to-end arranged along the direction of nozzle arrangement; Head 604 and 608 are interlaced end-to-end arranged along the direction of nozzle arrangement; Head 608 and 612 are interlaced end-to-end arranged along the direction of nozzle arrangement. The first group of print heads 6 can also include more multiple heads.

For example, for six color image printing, each row includes six heads which are used to print cyan ink, magenta ink, yellow ink, black ink, light cyan ink and light magenta ink. Two, three or more print heads in each row can be used to print the same color ink in the present invention.

Print heads in the second group of 7 are used to print coating ink. The second group of print heads 7 also includes three rows. The first row includes Head 71. The second row includes Head 72. The third row includes Head 73. The print heads in the second group 7 which jet the same color of ink are also interlaced end-to-end arranged along the direction of nozzle arrangement. That is to say, head 71 and head 72 are interlaced end-to-end arranged along the direction of nozzle arrangement; head 72 and head 73 are interlaced end-to-end arranged along the direction of nozzle arrangement. Two, three or more print heads in each row of the second group can be used. The second group of print heads 7 is used to print white ink in the embodiment such as foreground color printing, background color printing or backlit printing, which will be introduced in the next example. The second group of print heads 7 in the present invention can also be used to print inks with other effects on the media, such as transparent ink, polishing ink, anti-wear ink, etc.

In the example of the present invention, the first group of print heads 6 and the second group of print head 7 are aligned (adjacently) horizontally installed on head plate 2. The first group of print heads 6 shares the same axis with the second group of print head 7. The print heads in the first row of the first group share the same axis a-a with the print heads in the first row of the second group. The print heads in the second row of the first group share the same axis b-b with the print heads in the second row of the second group. The print heads in the third row of the first group share the same axis c-c with the print heads in the third row of the second group. The axis a-a, b-b and c-c are paralleled with Arrow A direction. The direction of Arrow A is the scanning direction of printing carriage 1. The movement direction of media is vertical to the movement direction of printing carriage 1. The media moves along the direction of Arrow B direction. The media moves unidirectionally under printing carriage 1. One or multiple UV curing device or pre-curing device can be installed on the two ends of printing carriage 1 to cure or pre-cure the ink drops on printing media.

During print, media moves along Arrow B under the print heads. The print heads on printing carriage 1 move horizontally forward (left) and backward (right) along the direction of Arrow A. The print heads jet ink on the media in the print mode set in the control system. By controlling the jetting ink of print heads, foreground color printing mode, background color printing mode, double sides with the same image printing mode, double sides with different images printing mode (five layers printing mode) and full color printing mode are realized by the inkjet printing apparatus in the present invention.

Figure 3:
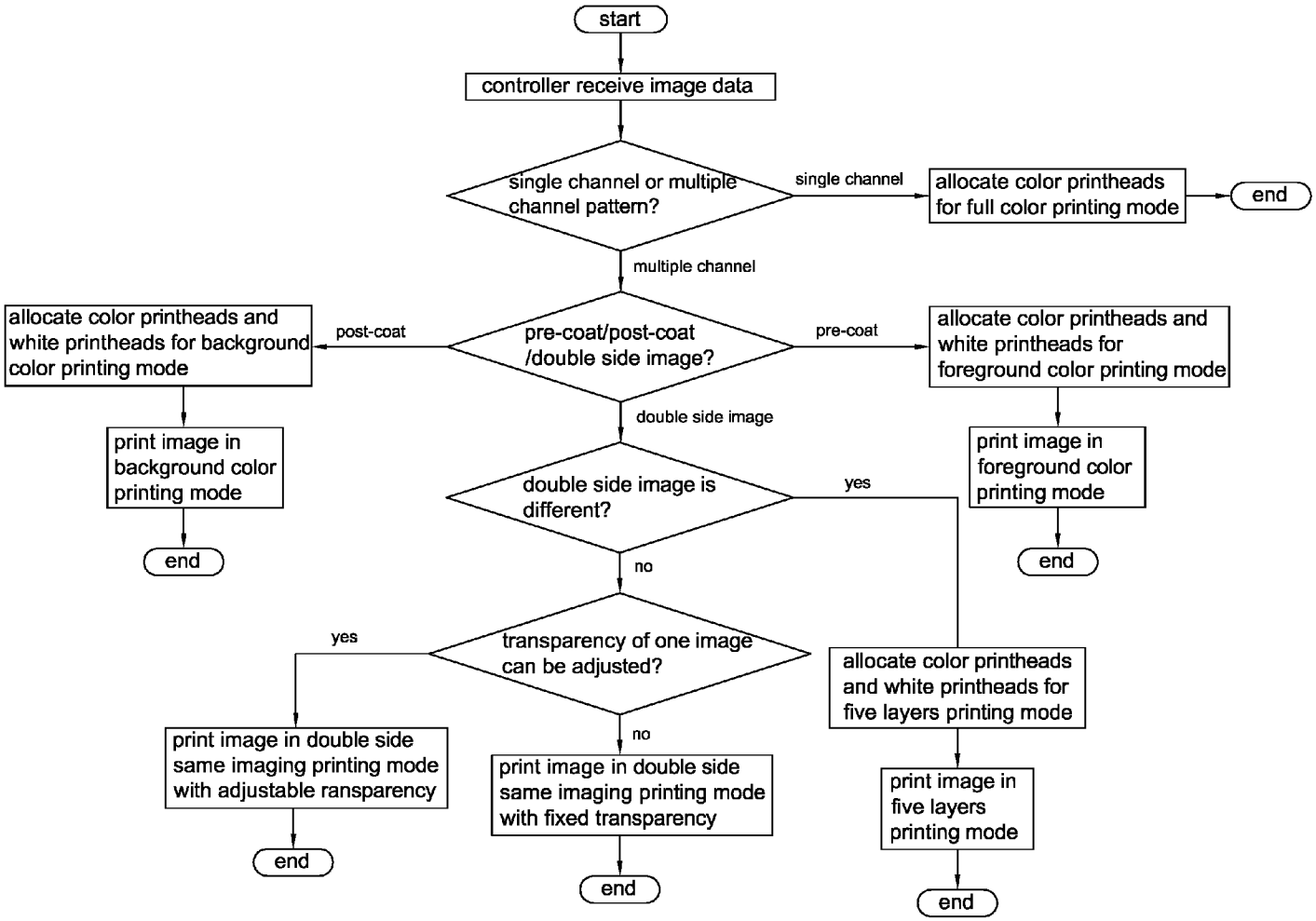
FIG. 3 is a flow chart of inkjet printing method in the present invention.

FIG. 3 is flow chart of the inkjet printing method in the present invention. When you start to print, the control system receives printing image data. Users select the single channel application pattern or multiple channel application pattern. Single channel application pattern supports full color printing. The control system controls heads 601-604 in the first row of the first group, heads 605-608 in the second row of the first group and heads 609-612 in the third row of the first group to work simultaneously to print the full color image on the media. Since three tandem print heads for each color are used to print, the print speed is three times that of each head. There are three choices by using multiple channel application pattern: foreground color printing mode, background color printing mode and double sides printing mode.

In foreground color printing mode, the control system controls heads 605-608 in the second row of the first group and head 73 in the third row of the second group to print color image layer and coating ink layer on the media. Heads 601-604 in the first row of the first group, heads 609-612 in the third row of the first group, head 71 in the first row of the second group and head 72 in the second row of the second group don't work. In background color printing mode, the control system controls head 71 in the first row of the second group and heads 605-608 in the second row of the first group to print coating ink layer and color image layer on the media. Heads 601-604 in the first row of the first group, heads 609-612 in the third row of the first group, head 72 in the second row of the second group and head 73 in the third row of the second group don't work. There are two types for double sides image printing mode according the images on both sides are the same or different: double sides with the same image printing mode and five layers printing mode (double sides with different images printing mode). Double sides with the same image printing mode refers to the color images on both sides is the same. In double sides with the same image printing mode, the control system controls heads 601-604 in the first row of the first group, heads 609-612 in the third row of the first group and head 72 in the second row of the second group work together. Heads 605-608 in the second row of the first group, head 71 in the first row of the second group and head 73 in the third row of the second group don't work. When printing the double sides with the same color image on both sides, the transparency for one layer of the color image can be adjustable or nonadjustable. Five layers printing mode refers to double sides with different images printing mode. In five layers printing mode, the control system controls heads 601-604 in the first row of the first group, heads 609-612 in the third row of the first group, the second nozzle section 6082 on head 608 in the second row of the first group, the first nozzle section 721 and the third nozzle section 723 on head 72 in the second row of the second group work together. The first nozzle section 6081 and the third nozzle section 6083 on head 608 in the second row of the first group, heads 605-607 in the second row of the first group, head 71 in the first row of the second group, head 73 in the third row of the second group, and the second nozzle section 722 on head 72 in the second row of the second group don't work. In five layers printing mode, the heads can also work in the following way: heads 601-604 in the first row of the first group, heads 609-612 in the third row of the first group, the second nozzle section 6082 on print 608 in the second row of the first group, the first nozzle section 721, the second nozzle section 722 and the third nozzle section 723 on head 72 in the second row of the second group work together. The first nozzle section 6081 and the third nozzle section 6083 on head 608 in the second row of the first Group, heads 605-607 in the second row of the first group, head 71 in the first row and head 73 in the third row of the second group don't work. Head 608 is black ink print head.

The embodiments below show multiple channel application pattern can be realized using the inkjet printing apparatus in the present invention.

Embodiment 1

Figure 5:
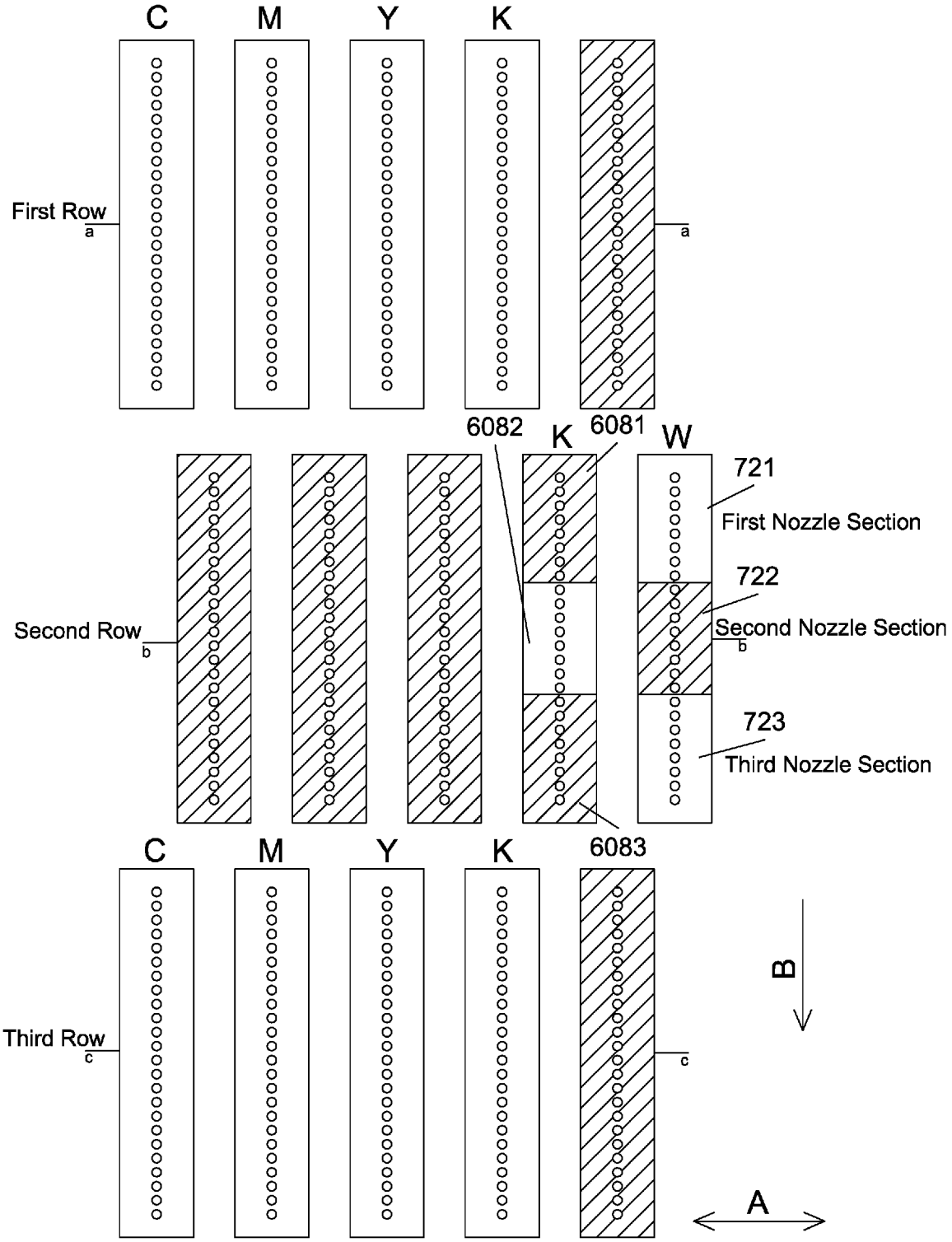
FIG. 5 is a sketch map of the top view of print head combination on carriage during five layers printing in another embodiment (double sides with different images printing) in the present invention.

FIG. 5 shows a sketch map of top view of print head combination on carriage during five layers printing (double sides with different images printing). In this printing mode, the printing carriage moves horizontally forward (left) and backward (right) along the supporting beam in the direction of Arrow A. In the figure, the print heads with oblique lines don't jet ink and the print heads without oblique lines jet ink under the control system. Since the media moves in the direction of Arrow B along the perpendicular with supporting beam, heads 601-604 in the first row of the first group print the first color printing image on the media first. When the carriage scans horizontally along the Arrow A, the first nozzle section 721 on print head 72 in the second row of the second group (The amount of the first nozzle section is ⅓ of all nozzles on a head. For example, the length of the first nozzle section is d1 and the total length of all nozzles on a head is d0, d0=3d1) prints the first white ink layer shielding the first color printing image. When the carriage scans for the next time, the printing media moves a step in (d0)/3 distance along the direction of Arrow B. The second nozzle section 6082 on print head 608 in the second row of the first group (The amount of the second nozzle section is ⅓ of all nozzles on a head. For example, the length of the second nozzle section is d2 and the total length of all nozzles on a head is d0, d0=3d2) prints black ink as coating layer on the first white ink layer. When the carriage scans for the next time, the printing media moves a step in (d0)/3 distance along the direction of Arrow B. The third nozzle section 723 on print head 72 in the second row of the second group (The amount of the third nozzle section is ⅓ of all the nozzles on a head. For example, the length of the third nozzle section is d3 and the total length of all the nozzles on a head is d0, d0=3d3) prints the second white ink layer on the black coating ink layer. When the carriage scans for the next time, the printing media moves a step in (d0)/3 distance along the direction of Arrow B. Heads 609-612 in the third row of the first group print the second color printing image on the second white ink layer. The heads work in this way until the printing is finished. In this invention, the length of the first, second and third nozzle sections on the head which jets black ink or white ink in the second row can be set according to the user's requirement, such as d1=d3=3 (d0)/8, d2=(d0)/4.

Figure 4:
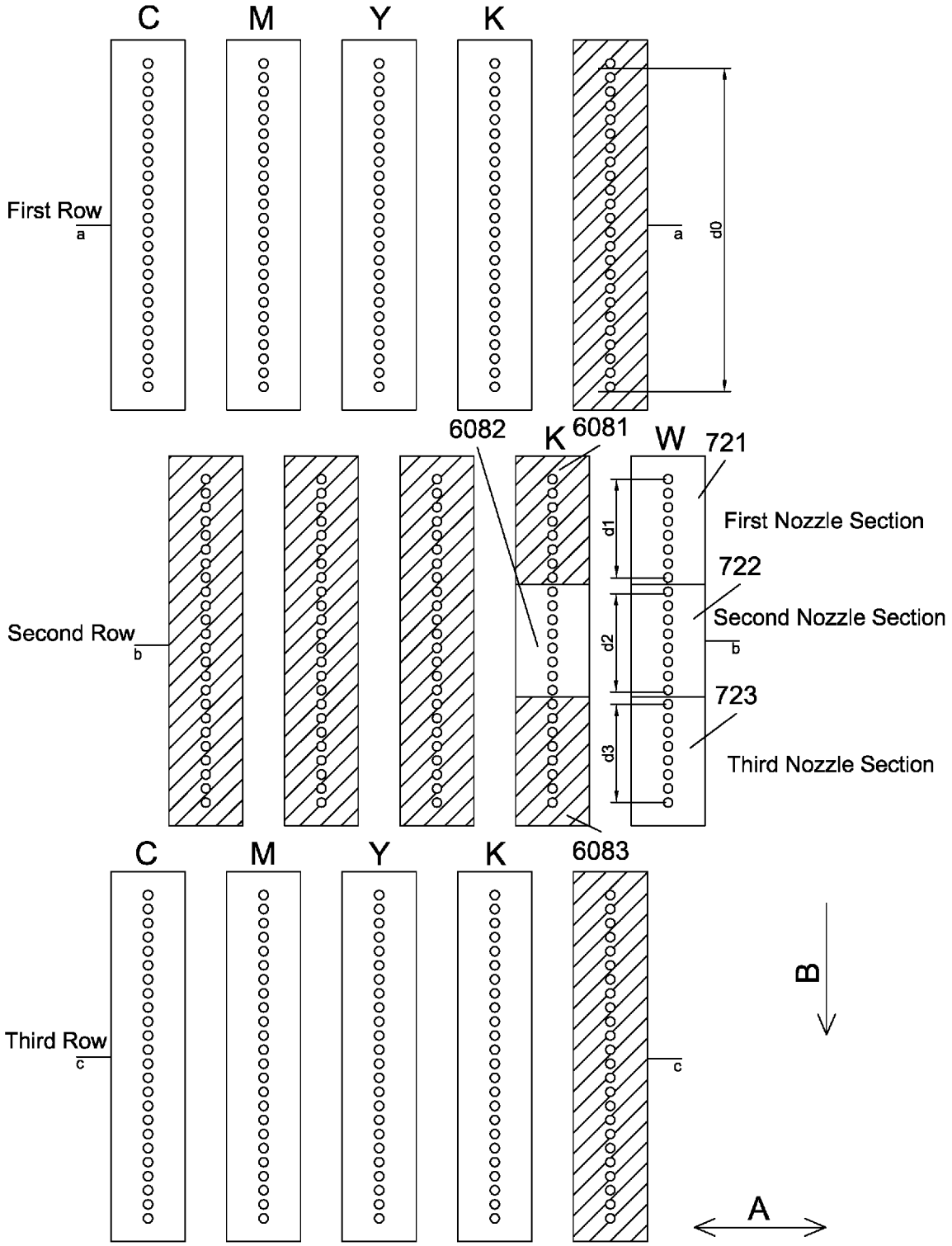
FIG. 4 is a sketch map of the top view of print head combination on carriage during five layers printing in the present invention.

FIG. 4 shows the top view of print head combination on carriage when double sides with different color images are printed during five layers printing in another embodiment in the present invention. In this double sides with different images printing mode, printing carriage moves horizontally forward (left) and backward (right) along the supporting beam in the direction of Arrow A. In the figure, the print heads with oblique lines don't jet ink and the print heads without oblique lines jet ink under the control system. Since the media moves in the direction of Arrow B along the perpendicular with supporting beam, heads 601-604 in the first row of the first group print the first color printing image on the media first. When the printing carriage scans horizontally along the Arrow A, the media moves a step in (d0)/3 distance along the direction of Arrow B. The first nozzle section 721 on print head 72 in the second row of the second group prints the first white ink layer on the first color printing image (The amount of the first nozzle section is ⅓ of all the nozzles on a head.) When the carriage scans for the next time, the media moves a step in (d0)/3 distance along the direction of Arrow B. The second nozzle section 6082 on print head 608 in the second row of the first group (The amount of the second nozzle section 6082 is ⅓ of all the nozzles on a head) and the second nozzle section 722 on print head 72 in the second row of the second group print gray ink together as coating layer on the first white ink layer. When the printing carriage scans for the next time, the media moves a step in (d0)/3 distance along the direction of Arrow B. The third nozzle section 723 on print head 72 in the second row of the second group prints the second white ink layer on gray coating ink layer (The amount of the third nozzle section is ⅓ of all the nozzles on a head.) When the carriage scans for the next time, the media moves a step in (d0)/3 distance along the direction of Arrow B. Heads

Figure 6:
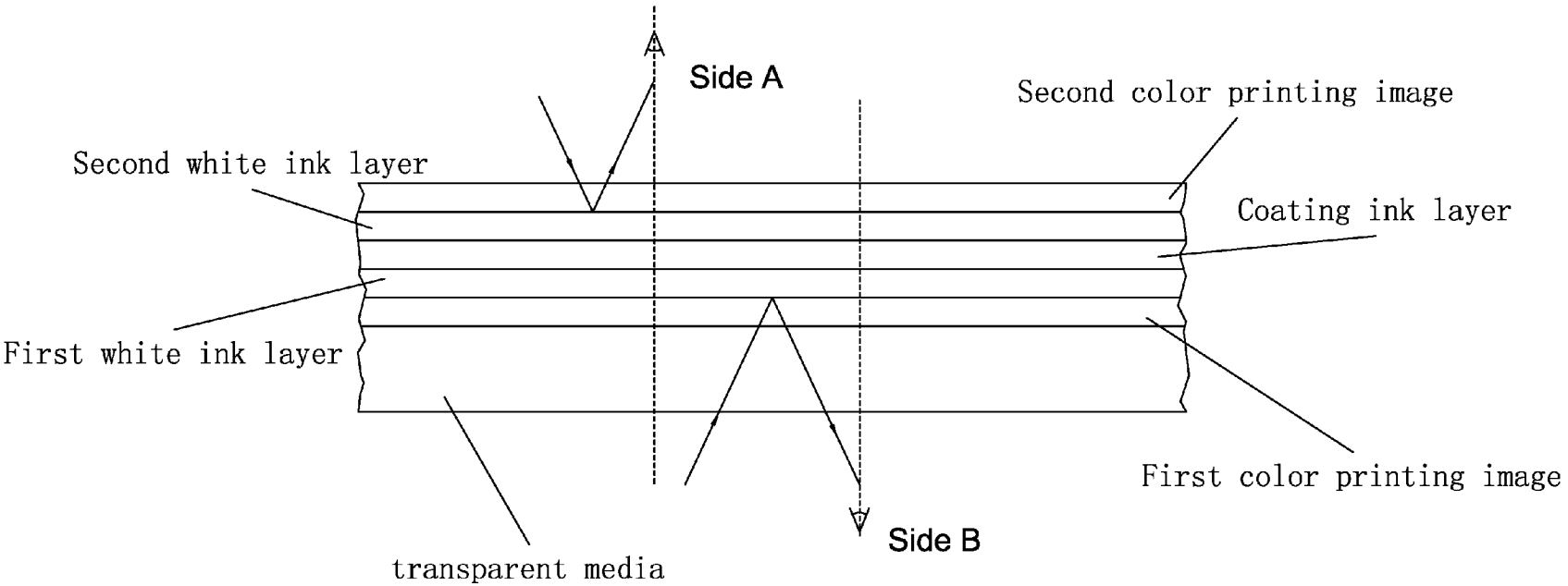
FIG. 6 is a profile map of five layers printing effect in the present invention.

609-612 in the third row of the first group print the second color printing image on the second white ink layer. The heads print in this way until the printing is finished. See FIG. 6 for the profile map of five layers printing effect. The five layers printing image includes the first color printing image, the first white ink layer, coating ink layer, the second white ink layer and the second color printing image which all lie in Side A of the printing media. Observers see the second color printing image from Side A of the printing media and see the first color printing image from Side B through the printing media which is transparent.

Embodiment 2

Figure 7:
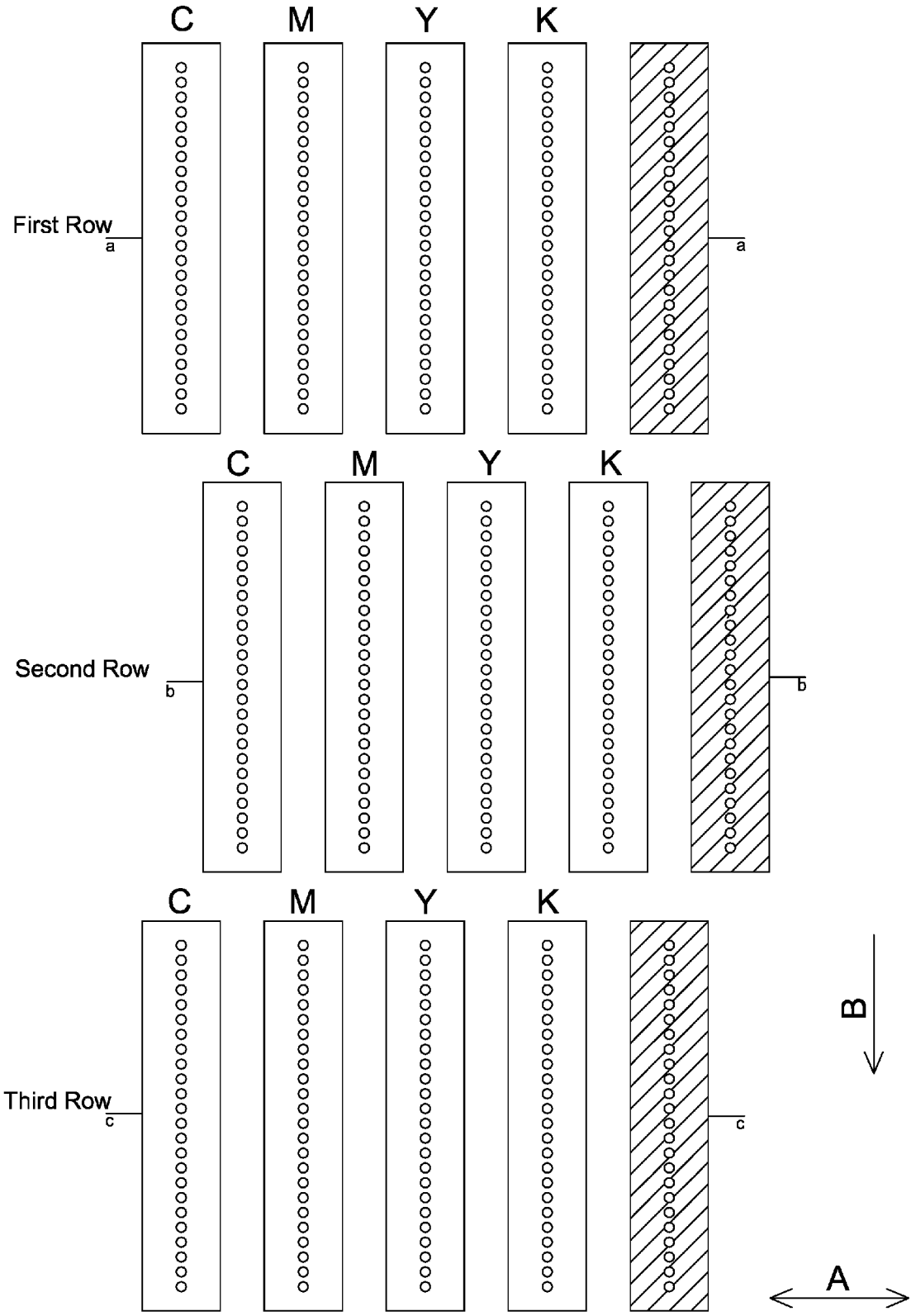
FIG. 7 is a sketch map of the top view of print head combination on carriage during the full color image printing in the present invention.

As shown in FIG. 7, the printing carriage moves horizontally forward (left) and backward (right) along the direction of Arrow A in full color printing mode. In the figure, the print heads with oblique lines don't jet ink and the print heads without oblique lines jet ink. That is to say, Heads 601-604 in the first row of the first group, heads 605-608 in the second row of the first group and heads 609-612 in the third row of the first group jet ink. Head 71, head 72 and head 73 in the three rows of the second group don't jet ink. During inkjet printing, the media moves in the direction of Arrow B. Heads 601-604, heads 605-608 and heads 609-612 in the three rows of the first group print color image simultaneously on the media. In the present invention, the two, three or multiple print heads can be used to print the same color of ink in the same row, so that print speed can be increased.

Embodiment 3

Figure 8:
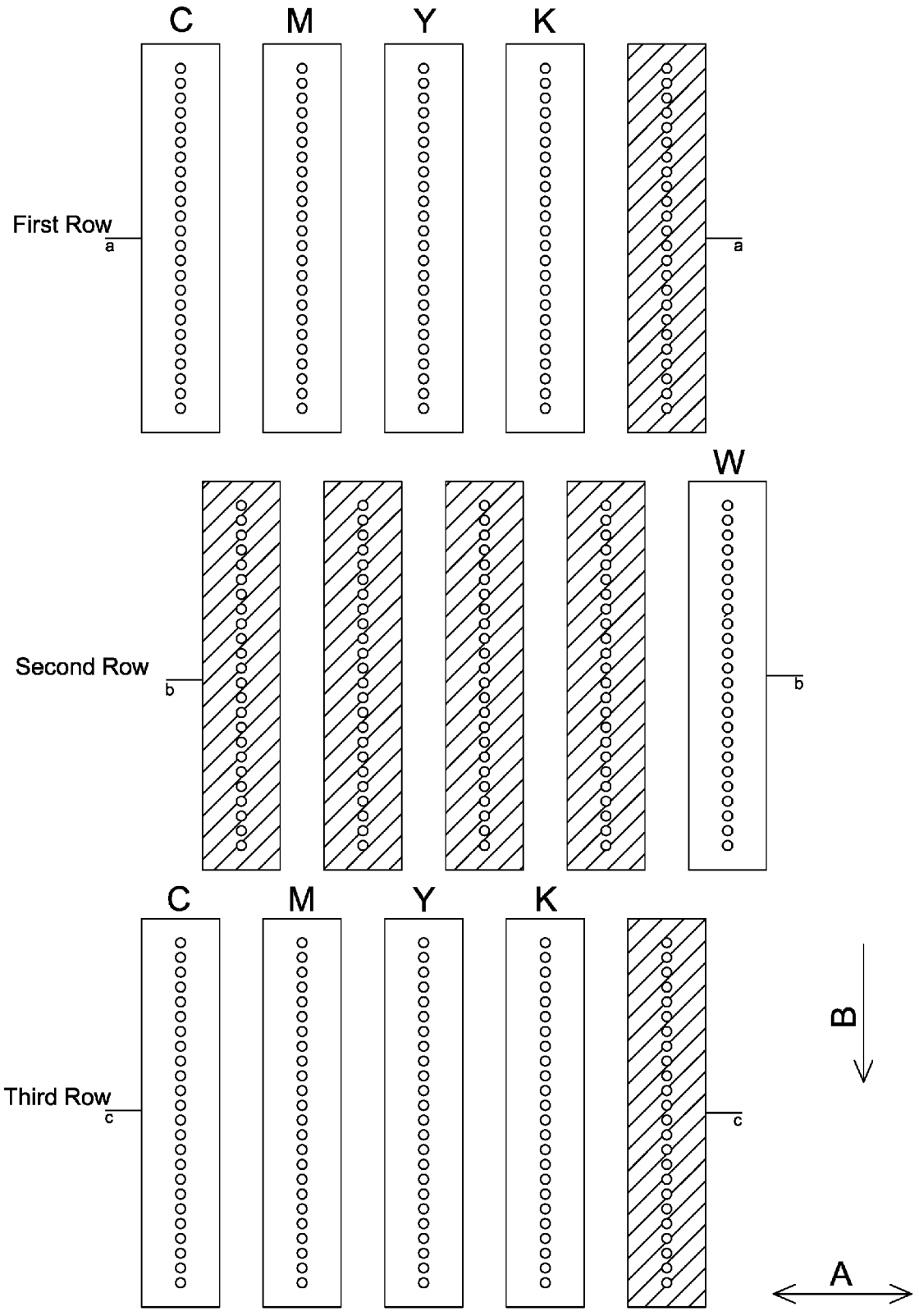
FIG. 8 is a sketch map of the top view of print head combination on carriage during double sides with the same image printing in the present invention.
Figure 9:
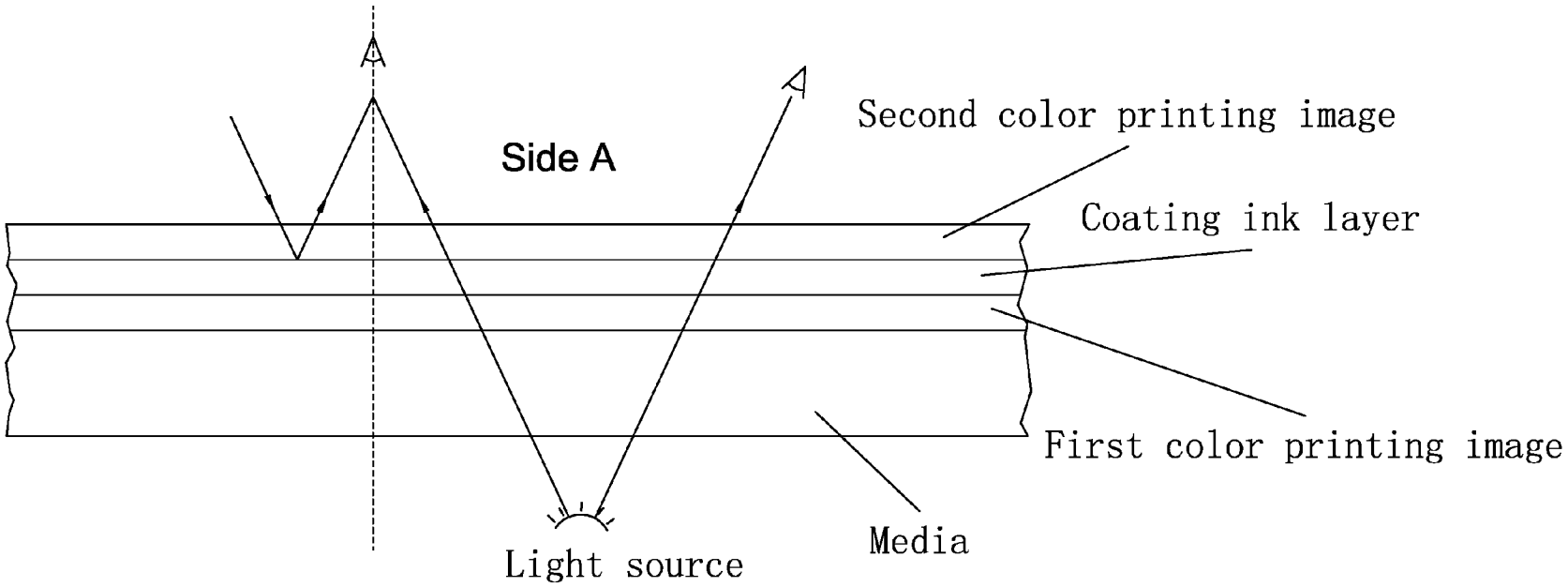
FIG. 9 is the profile map during double sides with the same image printing in the present invention.

FIG. 8 shows a sketch map of the top view of print head combination on carriage during double sides with the same image printing in the present invention, the printing carriage moves horizontally forward (left) and backward (right) along the direction of Arrow A in this mode. In the figure, the print heads with oblique lines don't jet ink and the print heads without oblique lines jet ink. That is to say, Heads 601-604 in the first row of the first group, Head 72 in the second row of the second group, Heads 609-612 in the third row of the first group jet ink. Heads 605-608 in the second row of the first group, Head 71 in the first row of the second group and Head 73 in the third row of the second group don't jet ink. During inkjet printing, the media moves in the direction of Arrow B. Heads 601-604 in the first row of the first group print the first color image on the transparent media. Head 72 in the second row of the second group prints the white ink shielding the first color image. Heads 609-612 in the third row 3 of the first group print the second color image on the white ink layer. Double sides with the same image printing mode is used for backlit image printing. (Of course, the first color image and second color image can be different in the present invention.) When the media is semitransparent such as flex banner, the first color image to be print is the same as the second color image and the transparency of the first color image to be printed can be adjusted. The appropriate transparency ensures the color depth of image on the flex banner is good for both day and night. When the media is transparent such as glass, the first color image to be printed is the same with the second color image and their transparency is non-adjustable. FIG. 9 shows the profile map of double sides with the same image printing: the first color printing image, white ink layer and the second color printing image are both on Side A of printing media. The light source is located on the opposite side A. Observers can see the first color printing image and the second color printing image from Side A of printing media. Since the first color printing image is the same as the second one, the backlit effect for color depth of double sides with the same image printing is more proper.

Embodiment 4

Figure 11:
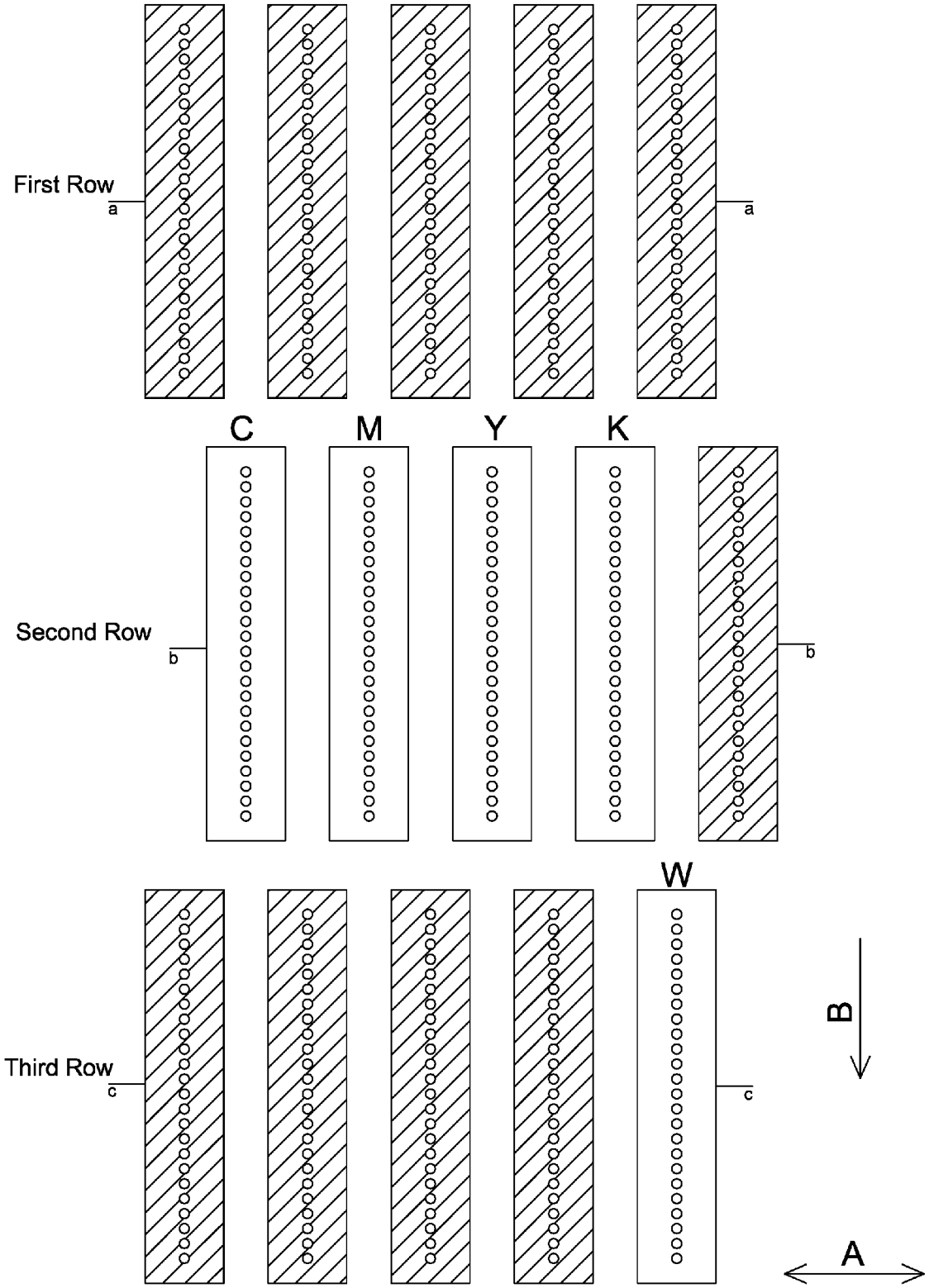
FIG. 11 is a sketch map of the top view of print head combination on carriage during foreground color printing in the present invention.

FIG. 11 shows a sketch map of the top view of print head combination on carriage in foreground color printing mode in the present invention. The printing carriage moves horizontally forward (left) and backward (right) along the direction of Arrow A. In the figure, the print heads with oblique lines don't jet ink and the print heads without oblique lines jet ink. That is to say, Head 73 in the third row of the second group and heads 605-608 in the second row of the first group jet ink. Print heads 601-604 in the first row of the first group, heads 609-612 in the third row of the first group, head 71 in the first row of the second group, and head 72 in the second row of the second group don't jet ink. During print, the media moves in the direction of Arrow B. Heads 605-608 in the second row of the first group print color image on the transparent media, and then head 73 in the third row of the second group print white ink on the color image. The heads will print in this way until the whole white ink layer and the whole color image layer are printed on the media. Two or multiple print heads can be used in the third row of the second group to jet white ink. Foreground color printing mode is used to print color image on the transparent media.

Embodiment 5

Figure 10:
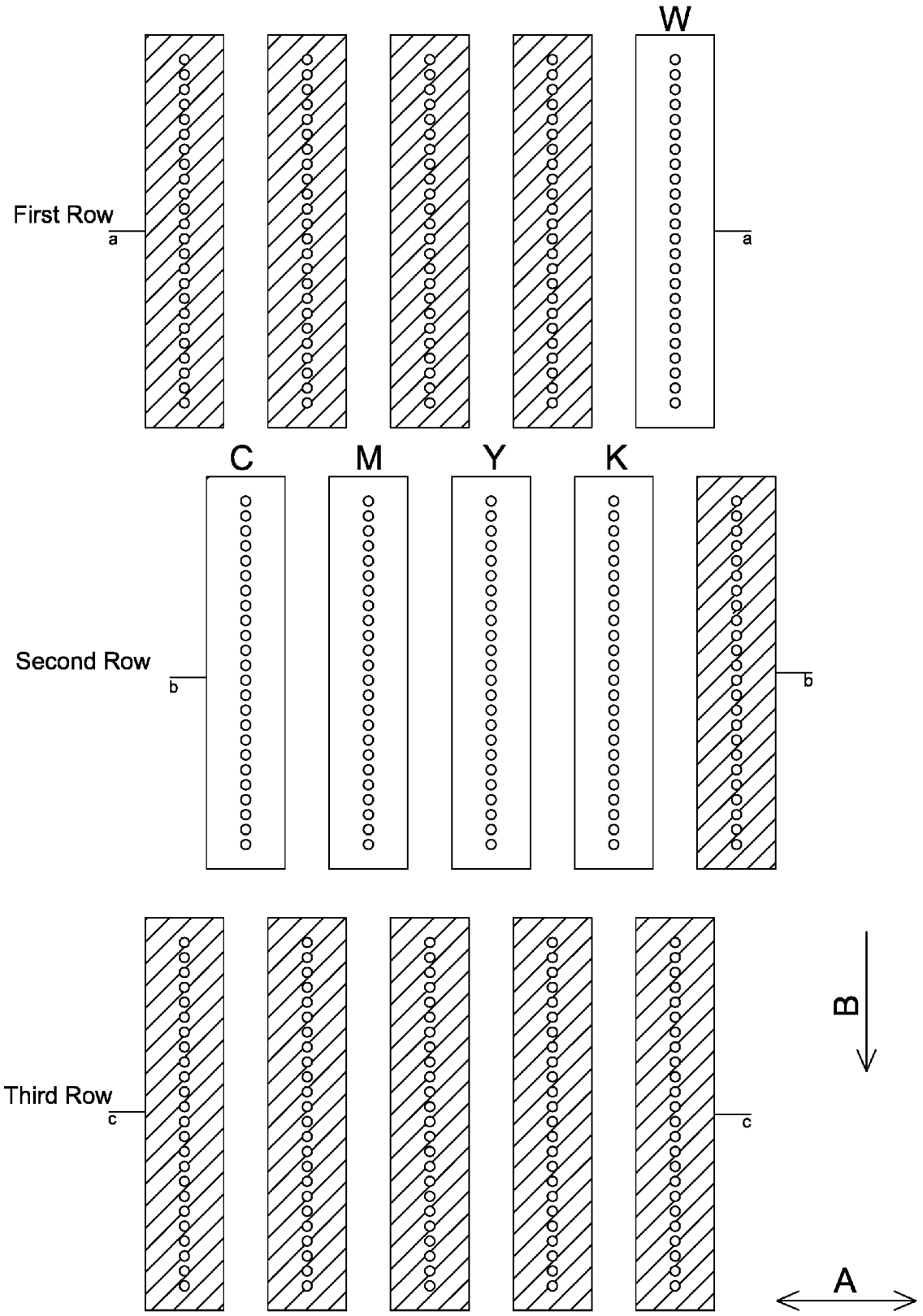
FIG. 10 is a sketch map of the top view of print head combination on carriage during background color printing in the present invention.

FIG. 10 is a sketch map of the top view of print head combination on carriage in background color printing mode in the present invention; the printing carriage moves horizontally forward (left) and backward (right) along the direction of Arrow A. In the figure, the print heads with oblique lines don't jet ink and those without oblique lines jet ink. That is to say, heads 605-608 in the second row of the first group and head 71 in the first row of the second group jet ink. Heads 601-604 in the first row of the first group, heads 609-612 in the third row of the first group, head 72 in the second row of the second group, head 73 in the third row of the second group don't jet ink. During inkjet printing, the media moves in the direction of Arrow B. Head 71 in the first row of the second group prints white ink on the transparent or non-white media. When the printing carriage returns to its home station, the media moves a step in d0 distance along the direction of Arrow B. During the printing carriage scans to its terminal, heads 605-608 in the second row of the first group print color image shielding white ink layer. The heads will print in this way until the whole white ink layer and the whole color image are printed on the media. Two, three or multiple print heads can be used in the first row of the second group to jet white ink. Usually the printing media of background color printing mode is non-white. To make the color brighter, a white ink layer should be printed on the non-white media. The white ink layer can also be a color ink according to your requirement. It is to be understood that any alternations and modifications made to the detailed embodiment herein shall not depart from the scope of the claim and spirit of the present invention.

What is claimed is:

1. A method of inkjet printing comprising:

a) controlling print heads in a first row of a first group on a carriage to print a first color printing image on a transparent media; the said print heads in the first row include color ink heads used to print a first color printing image;

b) controlling a first nozzle section on print heads in a second row of a second group to print a first white ink layer on the first color printing image; the said print heads in the second row of the second group include one or multiple heads which jet white ink;

c) controlling a second nozzle section on a black ink print head in a second row of the first group to jet black ink to form a coating layer on the first white ink layer; the print heads in the second row of the first group include one or multiple heads which jet black ink;

d) controlling a third nozzle section on print heads in the second row of the second group to print a second white ink layer on the said coating layer;

e) controlling print heads in a third row of the first group to print a second color printing image on the second white ink layer; the said print heads in the third row include color ink heads used to print the second color printing image.

2. The method of inkjet printing according to claim 1, wherein the said step c) is to control the second nozzle section on the black ink print head in the second row of the first group and the second nozzle section on the print heads in the second row of the second group to form the coating layer together on the first white ink layer; the print heads in a combined second row, which consists of combining the second row of the first group and the second row of the second group, include one or multiple heads which jet black ink and one or multiple heads which jet white ink.

3. The method of inkjet printing according to claim 2, wherein the said coating layer in step c) is gray coating layer which is mixed by black ink and white ink.

4. The method of inkjet printing according to claim 1, wherein the said print heads of the first group and those of the second group are aligned horizontally, and they share the same axis.

5. The method of inkjet printing according to claim 1, wherein the said print heads in the first group and second group are both the same print heads.

6. The method of inkjet printing according to claim 1, wherein the first color printing image is different from the second color printing image.

7. The method of inkjet printing according to claim 1, wherein the first nozzle section is composed of nozzles which lie on the top ⅓ of the print head in the second row; the second nozzle section is composed of nozzles which lie in the middle ⅓ of the print head in the second row; the third nozzle section is composed of nozzles which lie in the bottom ⅓ of the print head in the second row.

8. The method of inkjet printing according to claim 1, wherein the said print heads in the first and third rows of the first group jet color inks of Cyan, Magenta, Yellow and Black, and the number of the said print heads in the first and third rows of the first group is an integer multiple of four.

9. The method of inkjet printing according to claim 1, wherein the said print heads in the first and third rows of the first group jet color inks of Cyan, Magenta, Yellow, Black, Light Cyan and Light Magenta, and the number of the said print heads in the first and third rows of the first group is an integer multiple of six.

10. An inkjet printing apparatus using the method of inkjet printing according to claim 1 comprising: the print heads used to jet ink and a control system used to control the print heads to jet ink; the said print heads are arranged in the two groups: the print heads in the first group are used to jet color ink and the print heads in the second group are used to jet coating ink; the said print heads in the first group and second group are both composed by print heads in the first row, the second row and the third row along the transportation direction of the transparent medium; the said print heads in the first group and those in the second group both share a same axis; wherein the said print heads in the first and third rows of the first group both jet ink, and the second nozzle section on the black ink print head in the second row of the first group jets black ink; the said print heads in the first and third rows of the second group don't jet ink when the print heads in the second row of the second group jet ink.

11. The inkjet printing apparatus according to claim 10, wherein the said print heads in the second row of the first group and the second row of the second group are all divided into three nozzle sections: the first nozzle section is composed by top nozzles, the second nozzle section is composed by middle nozzles and the third nozzle section is composed by bottom nozzles; the first and third nozzle sections in the second row of the first group don't jet ink, when the second nozzle section in the second row of the first group jets ink; the first, second and third nozzle sections in the second row of the second group jet ink together.

12. The inkjet printing apparatus according to claim 10, wherein the said print heads in the second row of the first group and the second row of the second group are all divided into three nozzle sections: the first nozzle section is composed by top nozzles, the second nozzle section is composed by middle nozzles and the third nozzle section is composed by bottom nozzles; the first and third nozzle sections in the second row of the first group don't jet ink, when the second nozzle section in the second row of the first group jets ink; the first and third nozzle sections in the second row of the second group jet ink, when the second nozzle section in the second row of the second group doesn't jet ink.

13. The inkjet printing apparatus according to claim 11, wherein the first nozzle section is composed of nozzles which lie on the top ⅓ of the print head; the second nozzle section is composed of nozzles which lie in the middle ⅓ of the print head; the third nozzle section is composed of nozzles which lie in the bottom ⅓ of the print head.

14. The inkjet printing apparatus according to claim 11, wherein the first nozzle section is composed of nozzles which lie on the top ⅜ of the print head; the second nozzle section is composed of nozzles which lie in the middle ¼ of the print head; the third nozzle section is composed of nozzles which lie in the bottom ⅜ of the print head.

15. The inkjet printing apparatus according to claim 10, wherein the print heads in the first row and those in the second row are interlaced end to end along the direction of nozzle arrangement for both the first group and second group; the print heads in the second row and those in the third row are interlaced end to end along the direction of nozzle arrangement for both the first group and second group.

* * * * *